United States Patent [19]

Fisher

[11] 4,173,929

[45] Nov. 13, 1979

[54] PRINTER RIBBON ANTI-FOLD MECHANISM

[75] Inventor: Gary P. Fisher, Melbourne, Fla.

[73] Assignee: Documation Incorporated, Melbourne, Fla.

[21] Appl. No.: 855,767

[22] Filed: Nov. 29, 1977

[51] Int. Cl.[2] ..... B41J 35/08

[52] U.S. Cl. ..... 101/336; 400/224.2; 400/234; 400/248; 400/579; 226/21; 226/180

[58] Field of Search ..... 400/219.5, 224.2, 234, 400/246, 248, 579; 101/336; 226/3, 15, 16, 17, 18, 21, 22, 23, 180, 192, 193, 194, 184; 242/56 R

[56] References Cited

U.S. PATENT DOCUMENTS

| | | | |
|---|---|---|---|
| 848,294 | 3/1907 | Dey | 400/248 |
| 2,024,618 | 12/1935 | Whiting | 226/180 X |
| 2,577,195 | 12/1951 | Johnson | 226/23 |
| 2,801,102 | 7/1957 | Walter et al. | 226/17 |
| 2,997,871 | 8/1961 | Cutten et al. | 226/23 X |
| 3,057,293 | 10/1962 | Zurowski | 101/336 |
| 3,243,978 | 4/1966 | Gowin | 226/23 X |
| 3,380,637 | 4/1968 | Knapp | 226/21 X |
| 3,677,176 | 7/1972 | Foley et al. | 101/336 X |
| 3,701,318 | 10/1972 | Lozeau et al. | 101/336 |
| 3,719,975 | 3/1973 | Illarinov et al. | 226/21 X |
| 3,730,449 | 5/1973 | Satas et al. | 101/336 UX |
| 3,759,456 | 9/1973 | Moneagle et al. | 400/219.5 X |
| 3,905,534 | 9/1975 | Lee | 226/184 |
| 3,942,735 | 3/1976 | Marchio et al. | 242/56 R |

FOREIGN PATENT DOCUMENTS

| | | | |
|---|---|---|---|
| 1905574 | 8/1970 | Fed. Rep. of Germany | 226/22 |

*Primary Examiner*—Ernest T. Wright, Jr.

*Attorney, Agent, or Firm*—Duckworth, Hobby, Allen & Pettis

[57] ABSTRACT

An anti-fold apparatus for high speed printers to prevent the folding or creasing of a printer ribbon riding over rollers. The rollers each have spiral angular serrations thereon, and are mounted in two pairs with each roller in a pair having one end abutting the end of the other, and each being mounted at an angle to the elongated center axis of the other, so that a printer ribbon rolling thereon is directed away from the abutting ends of each pair of rollers to prevent creasing therein. A linkage connects the two pairs of rollers at their abutting ends for shifting the angular position of each pair simultaneously between first slanted positions, when the ribbon is moving in one direction, and second slanted positions, when the ribbon is moving in the reverse direction. The linkage is actuated by solenoids, actuated by the reversing of the ribbon.

17 Claims, 3 Drawing Figures

PRINTER RIBBON ANTI-FOLD MECHANISM

BACKGROUND OF THE INVENTION

The present invention relates to the control of printer ribbons in high speed printers, and especially to a printer ribbon anti-fold mechanism for preventing creasing or folding in the center of the ribbon riding on pairs of abutting rollers.

The present invention relates to high speed printers of the type having an on-the-fly, or fast moving character band having banks of hammers mounted adjacent thereto for hitting a character on the fast moving character band in the proper position as the character band moves thereby. This type of printer uses wide ribbons or carbon paper positioned to extend across the length of the character band so that simultaneous driving of hammer banks against characters in different positions on the character band will print a character on paper adjacent the ribbon. In high speed printers, the ribbon moves at a rapid speed through the printer to continuously place a fresh portion adjacent the character band as the hammers are fired.

It has been common in the past to provide a variety of mechanisms for controlling the skew of the ribbon, and this is accomplished by shifting rollers at a slight angle to shift the ribbon to one side or the other to maintain ribbon tracking and positioning relative to the hammers when ribbon motion occurs. A typical system for controlling ribbon skew utilizes skew drive motors rotating an eccentric cam, which displaces a skew arm assembly, which in turn is controlled by a microprocessor. The present invention, on the other hand, is used to maintain the wide ribbon taut without creases or folds, especially between abutting rollers, which fold would interfere with the printing operation of the printer. Accordingly, the present invention has a mechanism operating two separate pairs of rollers which the ribbon is riding on to maintain the ribbon taut even as it is shifted by separate control mechanisms to position the ribbon relative to the hammers.

SUMMARY OF THE INVENTION

A printer ribbon anti-fold mechanism for high speed printers has a support frame having a plurality of elongated ribbon support rollers mounted in pairs for the printer ribbon to roll over. Each roller has serrations thereon, and each roller in a pair is mounted abutting the other roller in the pair, with each abutting roller being mounted at an angle to the elongated center axis of the other. Two pairs of rollers are utilized, and each pair has its angular relationship different from the other, depending upon which direction the ribbon is moving over the rollers. A linkage is connected to pivot on the frame and is connected between abutting ends of each pair of rollers, and is actuated by solenoids to shift the angular position of the abutting rollers between first positions, when the ribbon is moving in one direction, and second positions, when the ribbon is moving in a second direction, so that the angular relationship between the rollers and the serrations maintain the ribbon taut on the rollers.

BRIEF DESCRIPTION OF THE DRAWING

Other objects, features, and advantages of the present invention will be apparent from the written description and the drawing, in which.

DESCRIPTION OF THE PREFERRED EMBODIMENT

Figure 1:
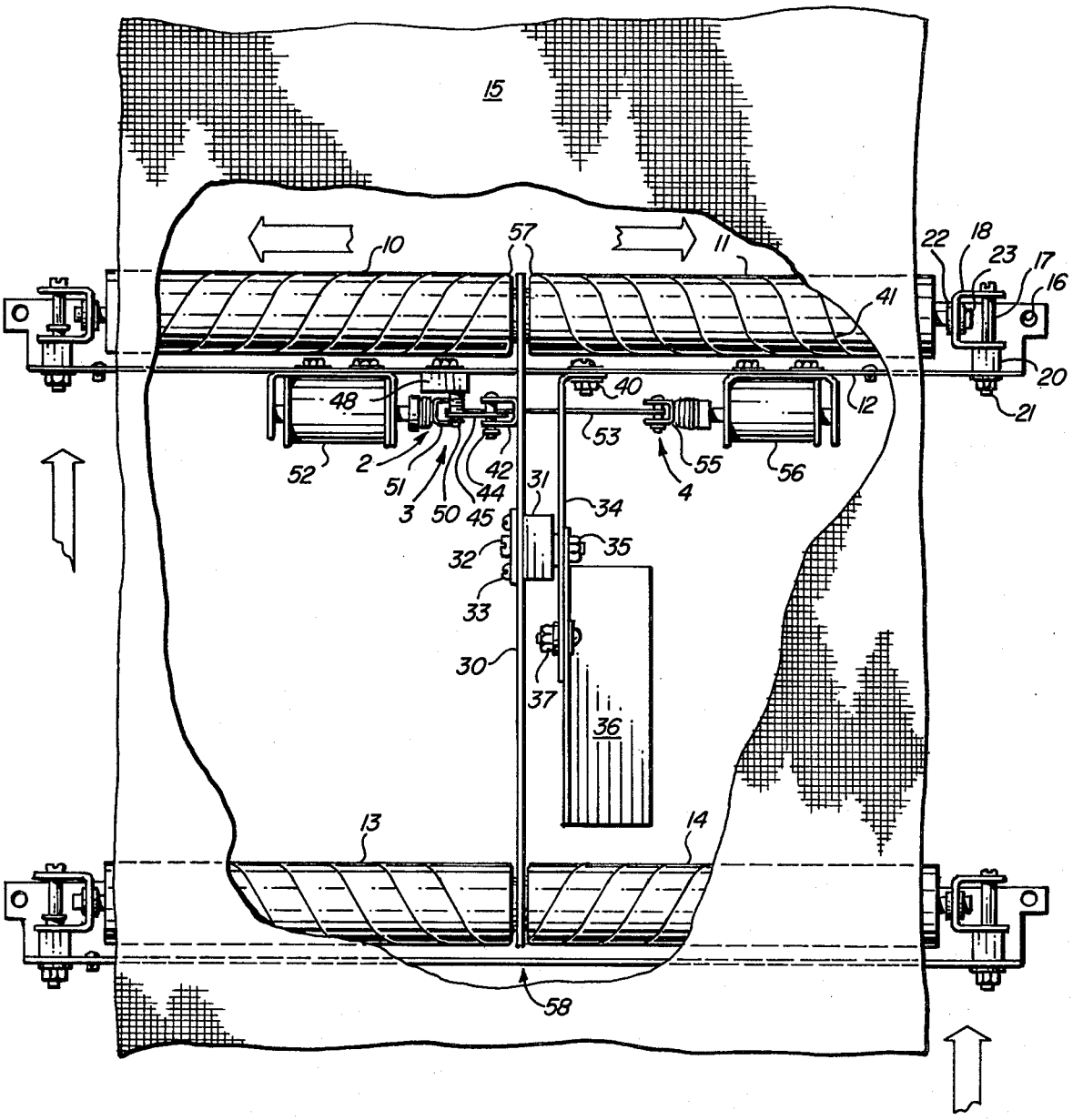
FIG. 1 is a fragmentary front elevation of a printer ribbon anti-fold mechanism in accordance with the present invention.
Figure 2:
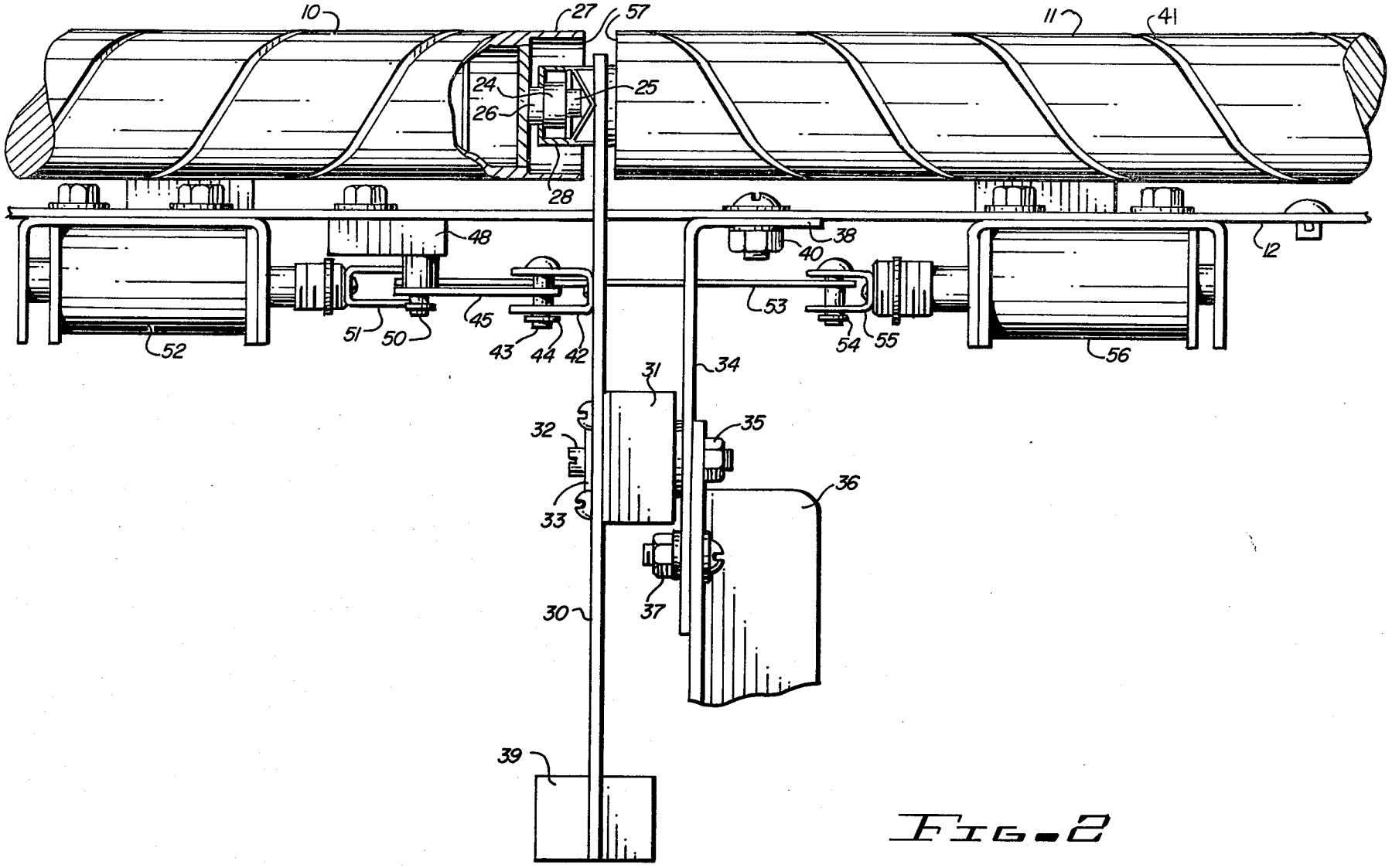
FIG. 2 is a front fragmentary sectional view of a solenoid actuated linkage for the printer ribbon anti-fold mechanism of FIG. 1.
Figure 3:
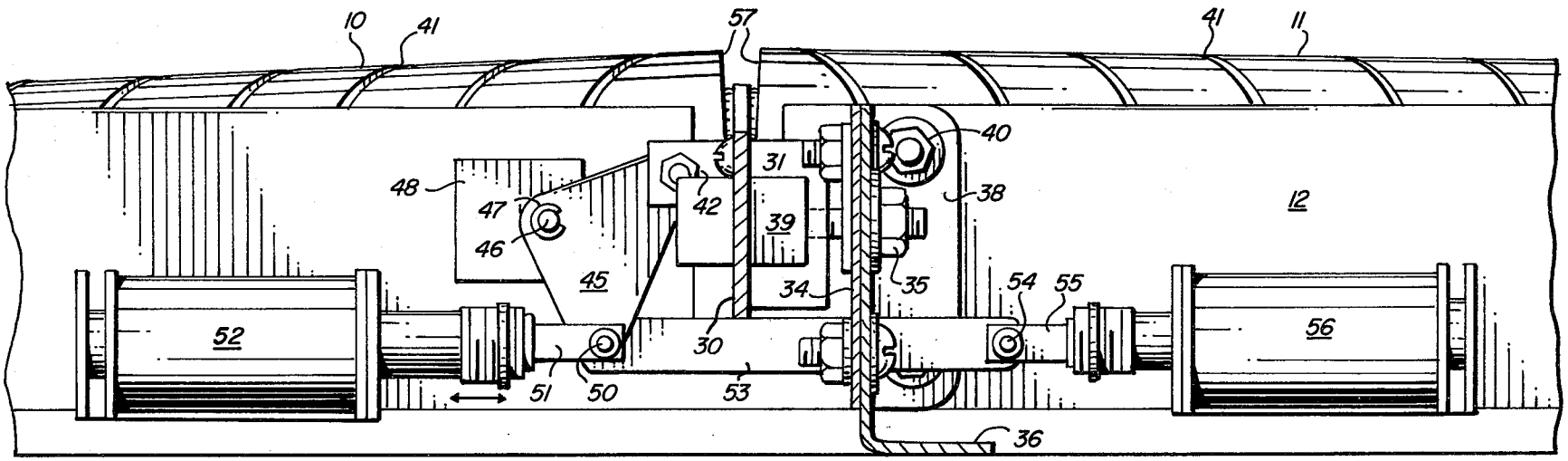
FIG. 3 is a sectional view of the actuating mechanism of the printer ribbon anti-fold mechanism of FIGS. 1 and 2.

Referring to the drawing, a first pair of rollers 10 and 11, and a second pair of rollers 13 and 14, are mounted on a high speed printer frame 12 for the printer ribbon 15 to roll over. Rollers 10, 11, 13 and 14 are all mounted in the same manner on mounting brackets 16, having a shaft 17 and a roller pivot 18 riding on the shaft 17. The shaft 17 is mounted in a sleeve 20 by nut 21 connected to the bracket 16. The roller pivot member 18 has a bearing 22 mounted therein with the end of the roller shaft 17 attached thereto with a bearing nut 23. This roller end system supports one end of all four rollers 10, 11, 13 and 14, and allows each roller 10, 11, 13 and 14 to move as the bearing pivot member 18 pivots on the shaft 17 to allow angular adjustments of each of the rollers 10, 11, 13 and 14 from one end thereof. Each roller 10, 11, 13 and 14 is mounted on its opposite end with a flange bearing 24 with a shaft 26 supported by a bearing nut 25. The shaft 26 protrudes from the end of each roller 10, 11, 13 and 14 but is overlapped by an annular portion 27 of each roller 10, 11, 13 and 14. The shaft 26 extends into a mounting sleeve 28 where bearing 24 and bearing nut 25 support the shaft 26 in a manner to allow slight movement of each roller 10, 11, 13 and 14, while not binding the rollers 10, 11, 13 and 14. Thus, each roller 10, 11, 13 or 14 is mounted so that it can be shifted on its elongated central axis during rotation without interfering with the operation of the roller and the printer ribbon 15 riding thereon. The support sleeve 28 is attached to a lever pivot support linkage 30 which is pivoted on a polymer bearing 31 locked with a threaded screw 32 and washer 33 to allow the linkage 30 to pivot, and thereby pivot the sleeves 28 and 39 on each roller end to shift the rollers 10, 11, 13 and 14 responsive to the movement of the linkage 30. Thus, the abutting ends of the rollers 10 and 11 and the abutting ends of the rollers 13 and 14 are each mounted to the lever pivot support linkage 30, which in turn is supported on the pivot bearing 31, which is mounted on a frame member 34 by a nut 35. The frame member 34 is further mounted with a bracket 36 bolted with a nut 37 to the main frame (not shown) of the high speed printer, and by a flanged portion 38, bolted at 40 to form a portion of the frame 12. Each of the rollers 10, 11, 13 and 14 has spiral or helical serrations 41 therein, which serrations 41 could, of course, be angular serrations extending over the roller. The serrations 41 tend to pull the ribbon 15 to either side in view of the slant in the rollers 10, 11, 13 and 14, as will be described in more detail hereinafter.

The lever pivot support linkage 30 has a U-shaped bracket 42 attached thereto having a shaft 43 passing therethrough, and held by pin 44. A bell crank 45 is held on the shaft 46 with a clip 47 mounted on a polymer bearing 48, which is attached to the frame 12. The bell crank 45 is attached at an additional point with a shaft 50 to a solenoid rod 51 of a solenoid 52, and also to a linkage member 53 which is in turn connected with a shaft 54 to the power arm 55 of a solenoid 56. Thus, both solenoids 52 and 56 are connected to the bell crank 45 so that when one solenoid 52 is pushing, the other solenoid 56 is pulling. The solenoids 52 and 56 drive the bell crank 45 between first and second positions, thereby shifting the lever pivot support linkage 30 between a first and second position. This shifts the rollers 10 and 11 at their abutting ends 57 in one direction, and the abutting ends 58 of the rollers 13 and 14 in the opposite direction. The top ribbon rollers 10 and 11 may slant in, when the ribbon 15 is riding thereover in a forward direction, while the bottom rollers 13 and 14 may slant out. When solenoids 52 and 56 are actuated upon the reversing of the direction of the ribbon 15 by the printer microprocessor, the bottom rollers 13 and 14 would then slant in, while the top rollers 10 and 11 slant out. This slanting in different directions between roller pair 10 and 11, and roller pair 13 and 14 in combination with the serrations 41 on the rollers 10, 11, 13 and 14 maintains the ribbon 15 on the rollers 10, 11, 13 and 14, with the ribbon 15 pulling to either side. The shifting of the angles of the rollers 10, 11, 13 and 14 maintains the ribbon 15 taut in either direction of movement by the simple actuation of a pair of solenoids 52 and 56.

The end of the ribbon 15 may be sensed in any manner desired, such as having a small bar located on the end portion of the ribbon to trip a mechanical switch which signals the printer microprocessor, which generates the signal to change the direction of movement of the ribbon 15. A short delay in printing during the reversal of the ribbon 15 prevents printing on the same ribbon portion during the change in direction.

Solenoids 52 and 56 are mounted with bolts to the frame 12. It will be clear to those skilled in the art, that one solenoid, or one solenoid and a spring can be utilized in place of solenoids 52 and 56, without departing from the spirit and scope of the invention. It should also be clear that most of the frame and brackets may be made of steel, but can be made of any metal desired, and the rollers may be coated with a rubber or plastic material mounted on a metal shaft or sleeve. Accordingly, the present invention is not to be construed as limited to the particular forms shown herein, which are to be considered illustrative rather than restrictive.

I claim:

1. A printer ribbon anti-fold mechanism comprising in combination:

support frame means;

a plurality of elongated ribbon support rollers, each roller having serrations thereon, and each roller mounted with one end abutting one end of at least one other roller of said plurality of rollers, said abutting rollers being mounted at an angle to the elongated center axis of each other roller, whereby a printer ribbon is directed away from the abutting ends of said abutting rollers to prevent creasing of the ribbon;

linkage means connected to said frame means and to one end of each said elongated roller for shifting the angular position of said abutting rollers between a first position, when siad ribbon is moving in one direction, and a second position when said ribbon is moving in a second direction, whereby said printer ribbon is directed away from the abutting ends of said rollers in either direction of travel of said rollers; and actuation means connected to said linkage means for actuating said linkage means and rollers between said roller's first and second position upon a change in direction of said ribbon mounted thereover.

2. The apparatus in accordance with Claim 1, in which at least two pairs of rollers are mounted with said linkage means connecting the abutting ends of each pair of rollers for actuation of both pairs of rollers by said actuation means simultaneously.

3. The apparatus in accordance with claim 2, in which said linkage means includes a pivoted lever arm pivoted on said frame means so that pivoting the abutting ends of one pair of rollers in one direction pivots the abutting ends of the other pair of rollers in a separate direction, whereby one pair of rollers will slant in, while the other pair of rollers slants out in one direction of travel, and the other pair of rollers will slant in while the one pair of rollers slants out in the opposite direction of travel of the ribbon.

4. The apparatus in accordance with claim 3, in which said actuation means includes at least one solenoid.

5. The apparatus in accordance with claim 4, in which said solenoid is connected to a bell crank pivoting on said support frame means, said bell crank being connected to said pivoted lever arm for shifting said lever arm responsive to actuation of said solenoid.

6. The apparatus in accordance with claim 5, in which a pair of solenoids are connected together for simultaneously actuating said bell crank.

7. The apparatus in accordance with claim 6, in which said pivoted lever arm is mounted on a polymer bearing, which is mounted to said support frame means for said lever arm to pivot thereon.

8. The apparatus in accordance with claim 7, in which each said roller is mounted to said support frame means at one end with a roller pivot mechanism to allow each roller to rotate and pivot on said one end.

9. The apparatus in accordance with claim 8, in which said roller pivot mechanism includes a U-shaped bracket riding on a shaft mounted to said support frame means and having a roller shaft bearing mounted thereon.

10. The apparatus in accordance with claim 9, in which the other end of each said roller is supported by a bearing mounted in a flanged sleeve attached to said pivoted lever arm, whereby shifting said linkage means will shift said bearing supported roller on one end.

11. The apparatus in accordance with claim 10, in which each roller has angular serrations thereon.

12. The apparatus in accordance with claim 11, in which said angular serrations are spirally formed on each said roller.

13. A printer ribbon anti-fold mechanism for a high speed printer comprising in combination:

a frame;

at least two pairs of ribbon supporting rollers, each pair of rollers having one roller mounted adjacent and abutting the end of the other roller of said pair, and the other end of each said roller rotably mounted on said frame in a pivoting bracket;

a lever arm connecting the abutting ends of each pair of rollers and supporting the abutting ends of each pair of rollers thereon, said lever arm being pivotally mounted between said pairs of rollers; and actuating means attached to said lever arm for pivoting said lever arm and each pair of abutting rollers between first positions, when a ribbon is moving in one direction, and second positions, when said ribbon is moving in a second direction, whereby each pair of rollers is angled at a different direction to each other in either direction of travel of said ribbon.

14. The apparatus in accordance with claim 13, in which each said roller has angular serrations thereon.

15. The apparatus in accordance with claim 14, in which said actuation means includes at least one solenoid mounted on said frame and connected through a linkage to said lever arm for actuating said lever arm, upon actuation of said solenoid.

16. The apparatus in accordance with claim 15, in which a pair of solenoids are connected to said frame and to a bell crank mechanism which is attached to said lever arm for actuating said lever arm upon actuation of said solenoids.

17. The apparatus in accordance with claim 16, in which said lever arm supports the abutting ends of each roller with a flanged bearing mount to allow said rollers to rotate while being pivoted without binding.

* * * * *